United States Patent [19]

Hohrein

[11] Patent Number: 4,515,064

[45] Date of Patent: May 7, 1985

[54] WEAPON RIM-FIRE CONVERSION UNIT II

[76] Inventor: Henry E. Hohrein, 3950 N. McDermitt Rd., Meridian, Id. 83642

[21] Appl. No.: 475,122

[22] Filed: Mar. 14, 1983

[51] Int. Cl.[3] ..... F41D 7/03

[52] U.S. Cl. ..... 89/128; 42/49 A; 42/77

[58] Field of Search ..... 42/49 A, 77; 89/29, 89/128

[56] References Cited

U.S. PATENT DOCUMENTS 3,771,415 11/1973 Into et al. ..... 89/128

3,776,095 12/1973 Atchisson ..... 42/49 A 4,220,071 9/1980 Selderman ..... 89/128

*Primary Examiner*—Stephen C. Bentley

*Attorney, Agent, or Firm*—Paul F. Horton

[57] ABSTRACT

This invention is designed for the conversion of the Mini-14 and AC-556 family of firearms as manufactured by the Sturm Ruger and Co., Inc. in Southport, Conn., for firing of smaller, less powerful ammunition for which it was not originally designed, by providing a conversion bolt assembly, auxiliary chamber assembly, operating rod assembly and magazine. The invention may also be employed in other firearms of similar construction without departing from the intent and scope of this invention.

3 Claims, 37 Drawing Figures

WEAPON RIM-FIRE CONVERSION UNIT II

BACKGROUND OF THE INVENTION

1. Field of the Invention

This invention is designed for hand carried firearms of selective automatic and semi-automatic operation and semi-automatic operation only. It is more specifically directed towards the provision of a conversion bolt assembly, auxiliary chamber assembly, operating rod assembly and magazine for easily converting a conventional weapon for the firing of smaller, less powerful ammunition for which it was not originally designed.

2. Description of the Prior Art

In the past, many conversion devices have been invented for readily converting conventional firearms to use ammunition that the firearm was not originally designed to use. There are many reasons for designing such conversion units: such as economy, ease of use, less sound and less recoil. One such design is that of John L. Pedersen, U.S. Pat. No. 1,555,420, Oct. 12, 1920. This patent discloses a bolt conversion assembly for converting a military high power bolt action rifle to fire smaller, less powerful ammunition in semi-automatic mode.

Another patent was granted Dec. 4, 1973, to Maxwell G. Atchisson, U.S. Pat. No. 3,776,095. This device is similar to Pedersen's except that it is for an automatic or semi-automatic firearm. Namely, the M-16 and AR-15 family of weapons.

Another prior art is that of the conversion of the Colt Firearm Company 45 automatic pistol to fire 0.22 long rifle ammunition. Otherwise known as the Colt Ace or Ace Conversion which has incorporated in its barrel a vibrator invented by David M. Williams of Godwin, N.C., and granted U.S. Pat. No. 2,090,657 on Aug. 24, 1937. A unique feature of this conversion is the floating chamber design or vibrator which accentuates the recoil of the 0.22 long rifle cartridge, enabling it to function properly.

SUMMARY OF THE INVENTION

This invention is particularly designed for the conversion of the Mini-14, AC-556 family of firearms manufactured by the Sturm Ruger & Co., Inc., Southport, Conn.

The names Ruger, Sturm Ruger, Mini-14 and AC-556 are the sole property of the Sturm Ruger & Co., Inc. and are used in this patent application for identification purposes only and are not intended to infringe on Sturm Ruger & Company's patents, copyrights, and trademark protection of these names or devices.

It will be obvious that the invention herein disclosed may also be employed in other firearms of similar construction and other calibers, i.e. M-1 Garand, M-14 and M-1 Carbine, without departing from the intent and scope of this invention. For purposes of brevity, only the names Mini-14 or conventional weapon will be used to refer to the firearm for which this invention is designed to convert.

The standard ammunition for the Mini-14 is the 0.223 Remington cartridge or 5.56 MM military designation. There are various occasions, however, when it may be advantageous to use other ammunition. For example, in the early training of soldiers and beginner marksmen, it may be beneficial to use the less expensive and less powerful ammunition of a rim-fire firearm. This would be beneficial to familiarization with the weapon during training and the transition of the trainee from the low-power up to the high-power original firearm would be much easier upon completion of training.

The barrel of the Mini-14 is designed to accomodate the 223 Remington Cartridge, but the bore of the barrel may use any of a number of bullets having nominal 0.22 caliber. The chamber of the Mini-14, however, will not properly accept for firing, smaller ammunition such as: 0.22 long rifle ammunition. Consequently, the concept of using smaller ammunition in the Mini-14 is feasible only with modification of the weapon, if the use of other small caliber weapons is to be avoided. The cost of 0.22 ammunition is less than 10 percent of the cost of 223 Remington ammunition. The use of 223 Remington ammunition on indoor shooting ranges may be prohibited because of sound levels and penetration power, and often adequate outdoor ranges are not available.

The conversion of the Mini-14 to the firing of smaller ammunition would have advantages in special military and police operations, such as clandestine warfare and use by swat teams. The subsonic 0.22 long rifle ammunition is easily silenced with a sound suppressor whereas the high velocity 0.223 Remington ammunition cannot be effectively silenced because of its super sonic "crack".

If the Mini-14 high-powered rifle is to be converted, there are a number of considerations which must be observed if the conversion is to be effective. For example, the conversion should be accomplished as simply as possible, and not require basic modification of the standard weapon. In addition, it is desirable for any conversion to be as inexpensive and simple as possible and be easily servicable. It is further desirable that a converted weapon have substantially the same characteristics in firing and use as the standard weapon, in order that training in the use of a converted weapon leads naturally to familiarization with an unconverted weapon.

It is therefore the object of this invention to provide a conversion assembly that is readily adaptable for use on a Mini-14 rifle, and that provides the above mentioned attributes necessary to the effective conversion of a high-powered firearm. According to the invention, the rifle is adapted to the firing of a smaller and low-powered ammunition, by providing a bolt assembly that may be easily and readily substituted for the standard bolt assembly in the weapon, an auxiliary chamber assembly and an operating rod and spring assembly to replace the standard operating rod and spring assembly. Further in accordance with the invention, the only other modification required for conversion of the standard weapon, is the insertion by standard technique of a magazine assembly adapted to function with the smaller ammunition.

According to the invention, the conversion consists of four basic assemblies. 1. The bolt assembly made of steel is constructed much like the bolt of the standard weapon with these exceptions: The bolt face is recessed to accomodate the rim of the 0.22 long rifle ammunition. The firing pin is positioned so as to strike the rim of the 0.22 long rifle cartridge as is the technique for igniting this type of ammunition. The extractor is shaped and placed to facilitate proper extraction. The bolt does not have an ejector attached to it. The ejector is located on a lip of the magazine assembly. 2. The steel auxiliary chamber assembly, the front portion of which is a barrel in the shape of the 0.223 Remington cartridge. The rear portion of this assembly is cylindrical with two locking lugs which can be locked into position by use of the standard rifles locking lug recesses. It is secured in this locked position by a set screw threaded through the left locking lug. In the center of this cylinder is the rear portion of the barrel hole which is chambered for the 0.22 long rifle cartridge. 3. The operating rod assembly, the rod of which is formed of steel has a handle at the rear for moving the rod and associated parts manually. Just forward of this handle is a round opening through which a cylindrical lug from the bolt assembly protrudes. On the underside near the rear of the rod are two small lugs that travel in grooves on the weapons receiver in the same technique as the standard weapons operating rod. The forward portion of the operating rod curves down and under the weapons barrel where the operating rod spring and operating rod spring guide rod cooperate to provide forward movement and tension of the combined assemblies in similar technique to the standard weapon. At the forward end of the operating rod spring guide rod is a guide rod support which fits over the conventional weapons gas piston and is grooved concave on the top to align with the underside of the weapons barrel for proper positioning, and is held onto the piston by a set screw. The rear portion of this support has a recess of which holds the forward end of the operating rod spring guide rod in its proper position. 4. The magazine assembly employed with the conversion assemblies of the invention may be of standard exterior configuration for the weapon, merely being adapted to hold and feed the smaller 0.22 long rifle ammunition.

BRIEF DESCRIPTION OF THE DRAWINGS

The invention will now be described in greater detail with reference to the accompanying drawings, in which.

This invention is designed for both semi-automatic weapons and weapons capable of both semi and full automatic operation. For the sake of brevity, only the semi-automatic weapon will be illustrated in these drawings and in no way precludes the application of this invention in the semi and full automatic version of the weapon.

DETAILED DESCRIPTION OF THE INVENTION

Figure 1:
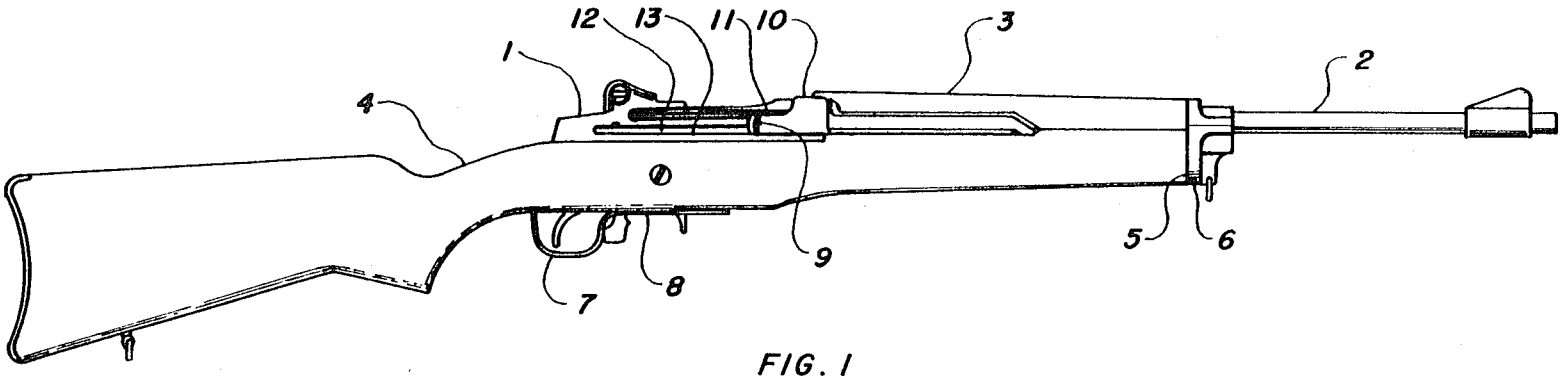
FIG. 1 is a right side view of a standard Mini-14 of the form in which the assemblies of the present invention may be employed.
Figure 2:
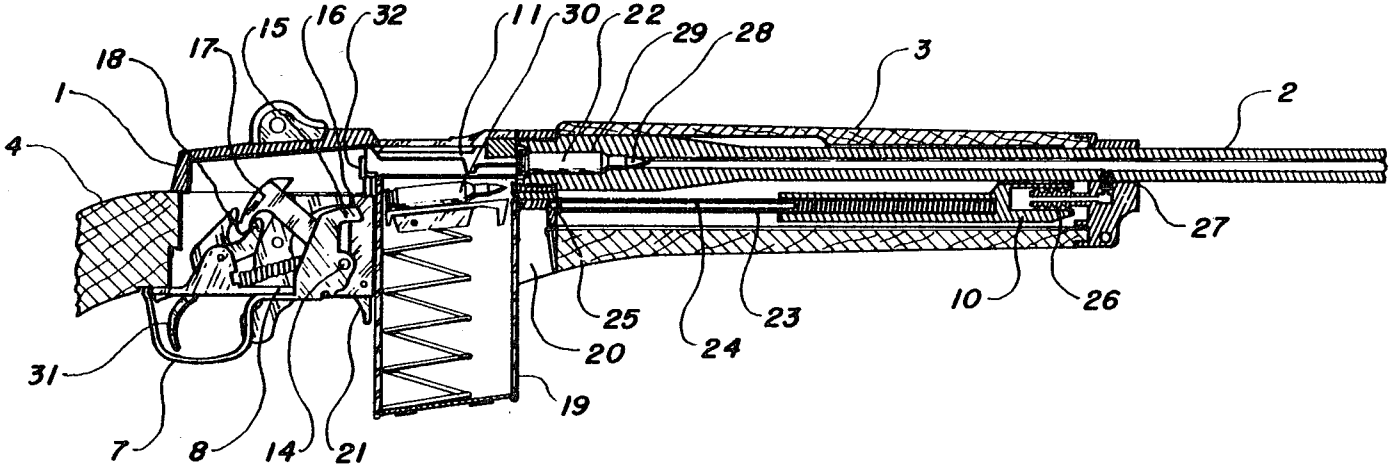
FIG. 2 is a partially cross-sectional view of a portion of the weapon of FIG. 1.

Referring now to the drawings, and more in particular to FIG. 1 therein is illustrated a typical conventional weapon which may employ the conversion device according to the invention. The illustrated weapon is a standard Mini-14 rifle, and includes a receiver 1 to which the barrel 2 is affixed. An upper hand guard 3 covers the rear portion of the barrel 2 and the stock 4 houses the receiver 1 and barrel 2. A forward stepped end of the stock 5 is retained in a recess of the gas port housing 6 near the front of the weapon and the stock 4 is attached to the receiver 1 by the binding action of the trigger guard 7 which is hingedly attached to the trigger and hammer assembly 8. The operating rod handle 9 is used for manually functioning the weapon by pulling the operating rod handle 9 to the rear, causing the operating rod 10 and the bolt 11 to travel rearward in unison. The operating rod 10 has lugs on the bottom and left side (not shown in FIG. 1) that travel in two grooves 12 and 13 on the right side of the receiver 1. The portions of the weapon of FIG. 1 which are of interest in the detailed explanation of the present invention are illustrated in simplified form in longitudinal-section in FIG. 2. This figure illustrates the receiver 1 and how the barrel is threaded into it. The trigger and hammer assembly 8 is held into the receiver 1 and stock 4 by the binding action of the trigger guard 7 which pivots on pin 14 and allows the lugs 15 to rotate into receiver recess 16. The hammer 17 and sear mechanism 18 are shown in the cocked position. A removable ammunition clip 19 is inserted into the clip opening 20 and is held into the receiver 1 by the clip latch 21. The Mini-14 shown in FIG. 2 is shown locked and loaded with the 223 Remington cartridge 22 in the chamber 29 and the barrel 2. The operating rod 10 is held forward by the operating rod spring 23, which is supported by the operating rod spring guide rod 24 and is held in place by the detent hole 25. The operating rod 10 encloses the gas piston 26 which receives gas pressure from the gas port 27 in the barrel 2 after the passage of the bullet 28 through the barrel 2, thus forcing the operating rod 10 rearward and causing the weapon to function. During this functioning, the bolt 11 rotates counter-clockwise to an unlocked position by a camming action in conjunction with the operating rod 10 and then proceeds rearward in the receiver 1 and extracting the empty cartridge case from the chamber 29. Moving rearward, the rear portion of the bolt 11 comes into contact with the hammer 17, thus pivoting it down until it comes into contact with sear mechanism 18.

The extractor, housed in the bolt 11 fully extracts the empty cartridge case and when it clears the chamber 29, it is ejected by an ejector also housed in the bolt 11. When bolt 11 has reached maximum recoil, it then starts moving forward from pressure exerted on operating rod 10 by the operating rod spring 23. The lower front edge of the bolt 11 comes into contact with the fresh cartridge 30 in ammunition clip 19 and as fresh cartridge 30 moves forward, it enters chamber 29. When fully chambered, the bolt 11 then rotates clockwise to a locked position with the bolts locking lugs (not shown) locked into locking lug recesses (not shown) in the forward part of the receiver 1. In semi-automatic mode, the weapon is now ready to fire again by pulling the trigger 31 which releases the hammer 17 to strike the firing pin 32 which in turn strikes the primer of the fresh cartridge 22 in the chamber 29.

In full automatic mode, after the bolt 11 has fully loaded and locked a fresh cartridge 30 into the chamber 29, a portion of the operating rod comes into contact with the trip lever (not shown) which is connected to the full automatic sear mechanism which in turn releases the hammer 17 to strike the firing pin 32. While the trigger 31 is being held to the rear, the weapon will continue to function automatically until the trigger 31 is released or all ammunition is spent.

Figures 3, 4:
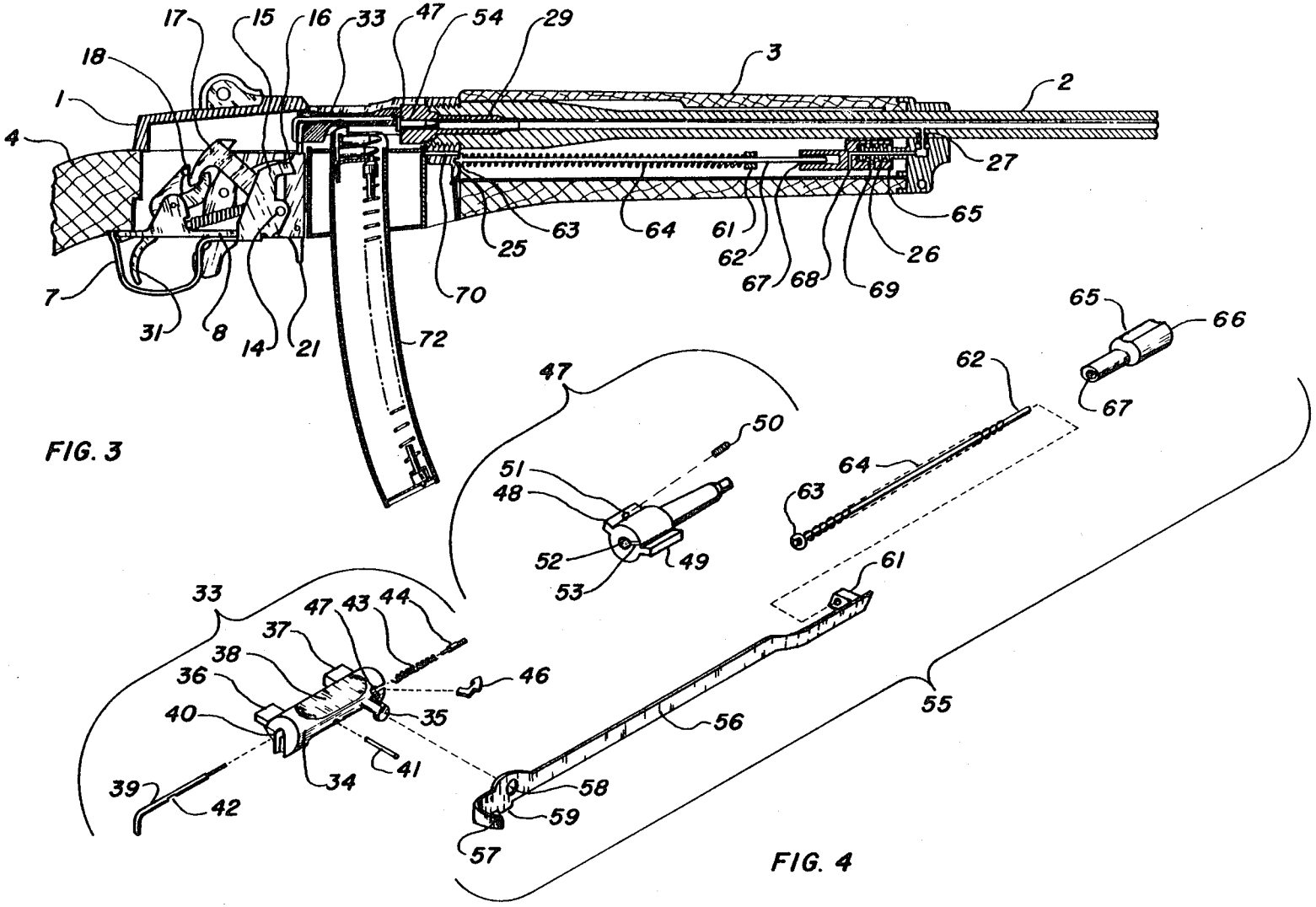
FIG. 3 is a partially cross-sectional view of a portion of a weapon corresponding to that shown in FIG. 2, but in which the bolt, operating rod and spring and magazine have been replaced by the conversion bolt assembly, auxiliary chamber assembly, operating rod and spring assembly and modified magazine according to the invention.
FIG. 4 is an exploded perspective view of the components of the bolt assembly, auxiliary chamber assembly and operating rod and spring assembly, according to the invention.
Figure 5:
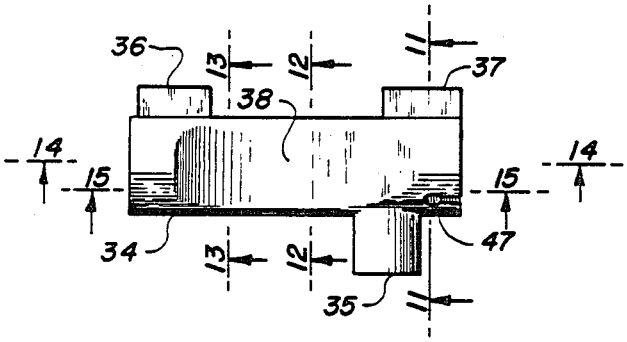
FIG. 5 is a top view of the bolt of FIG. 4.
Figure 6:
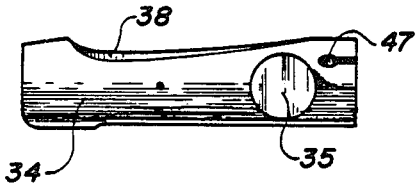
FIG. 6 is a right side view of the bolt of FIG. 5.
Figure 7:
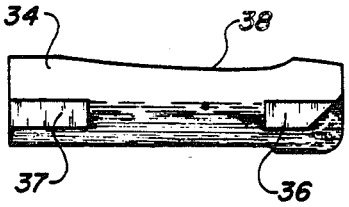
FIG. 7 is a left side view of the bolt of FIG. 5.

The components of the weapon rim-fire conversion unit according to the present invention are illustrated in the exploded perspective view of FIG. 4 and in assembled form in the partial cross-sectional view of FIG. 3. Referring now to FIGS. 3 and 4, the weapon rim-fire conversion unit is comprised of a bolt assembly 33 of which bolt 34 is cylindrical in shape with an operating rod lug 35 on the right side and two guide lugs 36 and 37 on the left side. The top of the bolt 34 has a shallow recess 38 for clearance. Firing pin 39 inserts into hole 40 and is movably held in bolt 34 by pin 41 and notch 42. The extractor spring 43 and notched plunger 44 assemble into hole 45 (not shown) in the face of the bolt 34. When the extractor spring 43 and notched plunger 44 are compressed, the extractor 46 may be inserted into hole 147 and when extractor spring 43 and notched plunger 44 are released, the extractor 46 is pivotally held in place.

The auxiliary chamber assembly 47, the rear portion of which is cylindrical in shape and having locking lugs 48 and 49 that are positioned and sized so as to use the receiver's 1, bolt locking lug recesses (not shown) to lock the auxiliary chamber assembly 47 into the receiver 1 and chamber 29 in similar fashion to that of the conventional weapons bolt 11 in FIG. 2. The set screw 50 is threaded into locking lug 48 at threaded hold 51 and when seated, will prevent the auxiliary chamber assembly 47 from rotating counter-clockwise and becoming unlocked and out of alignment. The forward portion of the auxiliary chamber 47 has the shape of the cartridge which the conventional weapon is chambered for. (223 Remington). On the rear face of the auxiliary chamber assembly 47 is a recess 53 which is positioned to accept the extractor 46 of bolt assembly 33. The auxiliary chamber assembly 47 has a hole 52 in the center of it which extends the full length of the assembly. The rear portion of hole 52 is chambered for the 22 rim-fire cartridge 54 that is to be employed in the conversion unit. The forward portion of hole 52 is of a size to allow a smooth transition of the bullet of the 22 rim-fire cartridge 54 into the rifled bore of the weapons barrel 2, as the bullet of the 22 rim-fire cartridge 54 is the same nominal diameter as that of the 223 Remington cartridge utilized in the conventional weapon.

Figure 27:
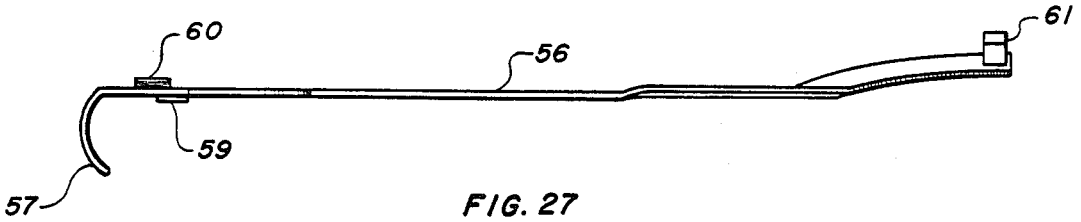
FIG. 27 is the top view of the operating rod.
Figure 28:
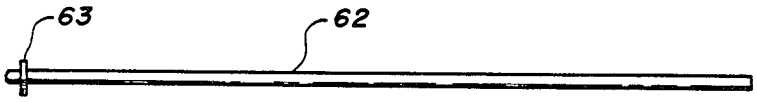
FIG. 28 is the operating rod spring and operating rod spring guide rod.
Figure 28:
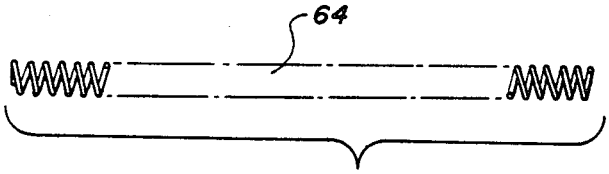
Figure 29:
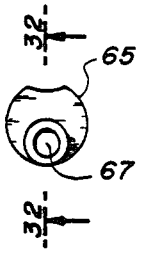
FIG. 29 is the rear end view of the guide rod support.
Figure 30:
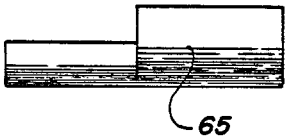
FIG. 30 is the right side view of the guide rod support.
Figure 31:
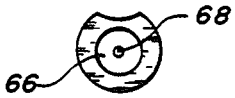
FIG. 31 is the front end view of the guide rod support.
Figure 32:
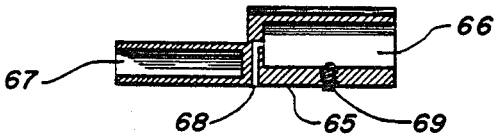
FIG. 32 is a longitudinal section through guide rod support in FIG. 29 along lines 32—32.

The operating rod assembly 55 includes an operating rod 56 having a handle 57 at the rear end for manually operating the weapon. Just forward of the handle is a hole 58 that is positioned and sized to receive the operating rod lug 35 of the bolt 34 in FIG. 4. On the bottom, near the rear of the operating rod 56 is a lug 59 and on the left side, also at the rear of the operating rod 56, is another lug 60, FIG. 27, which cooperate in the same technique as the conventional weapons operating rod 10 to attach the operating rod 56 to the receiver 1 by having lugs 59 and 60 slidably placed in two grooves 12 and 13, running longitudinally on the right side of the receiver 1 shown in FIG. 1.

The forward end of the operating rod 56 is shaped so as to clear the wood of the stock 4 and the upper handguard 3, as the operating rod 10 of the conventional weapon does. Attached to the end of the operating rod 56 is a guide block 61 with a hole in it to receive the operating rod spring guide rod 62. The operating rod spring guide rod 62, FIG. 4 has a small bearing flange 63 near the rear end against which the operating rod spring 64 is held when the guide block 61 is slidably fitted onto the forward end of the operating rod spring guide rod 62. The forward support 65 has a hole in the front end which fits over the gas piston 26 of FIG. 3 and is grooved longitudinally on the top to fit the curved contour of the underside of the barrel 2 to prevent rotation of the forward support 65 on the gas piston's 26 axis. The forward support 65 is held on the weapons gas piston 26 by a set screw 69 on the underside of the forward support 65. A small vent passage 68 located in the interior of the forward support 65 to bleed off the gases that come through the gas port 27 from the explosion that occurs in the barrel 2 during firing of the weapon. The operating rod spring guide rod 62 fits into hole 67 for support and proper alignment of the operating rod spring guide rod 62. The bearing flange 63 of the operating rod spring guide rod 62 is fitted into the detent hole 25, FIG. 3, and is held there by spring pressure from the operating rod spring's 64 pressure on the bearing flange 63 which also exerts pressure on the forward ammunition clip latch detent 70.

Figure 8:
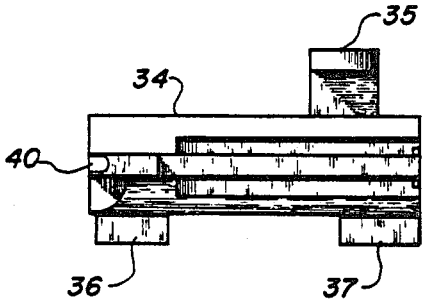
FIG. 8 is a bottom view of the bolt of FIG. 5.
Figure 9:
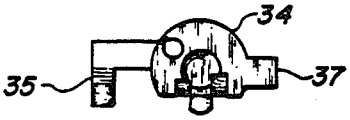
FIG. 9 is a front view of the bolt of FIG. 5.
Figure 10:
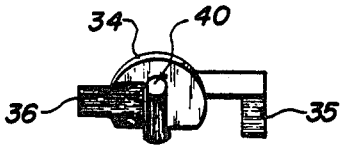
FIG. 10 is a rear view of the bolt of FIG. 5.
Figure 11:
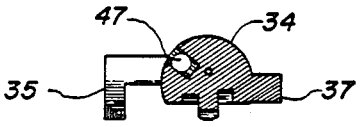
FIG. 11 is a cross-sectional view of the bolt of FIG. 5, along the lines 11—11.
Figure 14:
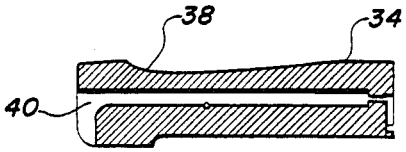
FIG. 14 is a longitudinal-sectional view of the bolt of FIG. 5, along lines 14—14.
Figure 12:
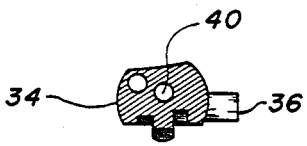
FIG. 12 is a cross-sectional view of the bolt of FIG. 5, along the lines 12—12.
Figure 15:
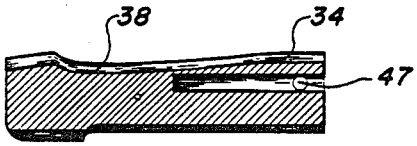
FIG. 15 is a longitudinal-sectional view of the bolt of FIG. 5, along lines 15—15.
Figure 13:
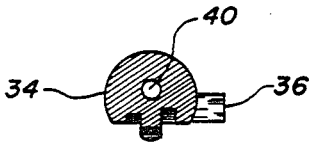
FIG. 13 is a cross-sectional view of the bolt of FIG. 5, along lines 13—13.
Figure 16:
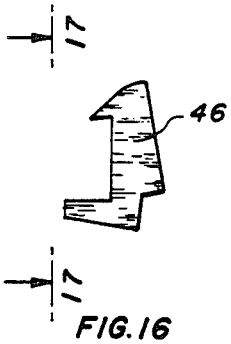
FIG. 16 is a side view of the extractor in bolt assembly FIG. 4.
Figure 17:
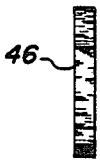
FIG. 17 is an edge view of the extractor of FIG. 16, along lines 17—17.
Figure 18:
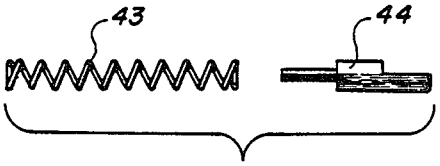
FIG. 18 is a side view of the extractor spring and notched plunger in bolt assembly in FIG. 4.
Figure 19:
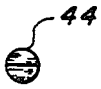
FIG. 19 is an end view of the extractor notched plunger in bolt assembly in FIG. 4.
Figure 20:
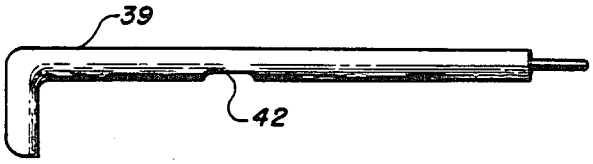
FIG. 20 is the right side view of the firing pin in bolt assembly in FIG. 4.
Figure 21:
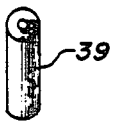
FIG. 21 is the front end view of the firing pin of FIG. 20.
Figure 22:
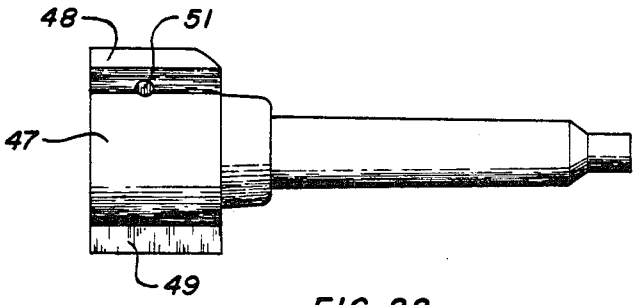
FIG. 22 is the top view of the auxiliary chamber in FIG. 4.
Figure 23:
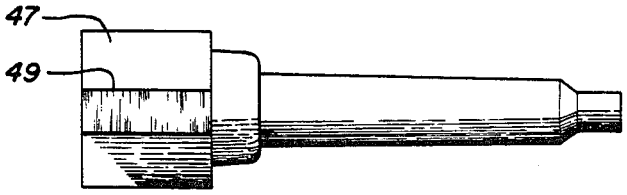
FIG. 23 is the right side view of the auxiliary chamber in FIG. 4.
Figure 24:
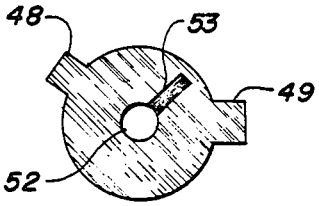
FIG. 24 is the rear end view of the auxiliary chamber in FIG. 4.
Figure 25:
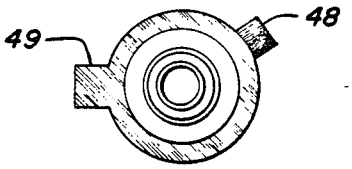
FIG. 25 is the front end view of the auxiliary chamber in FIG. 4.
Figure 26:
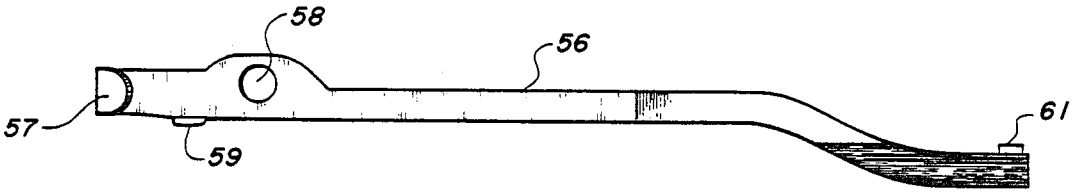
FIG. 26 is the right side view of the operating rod.
Figure 33:
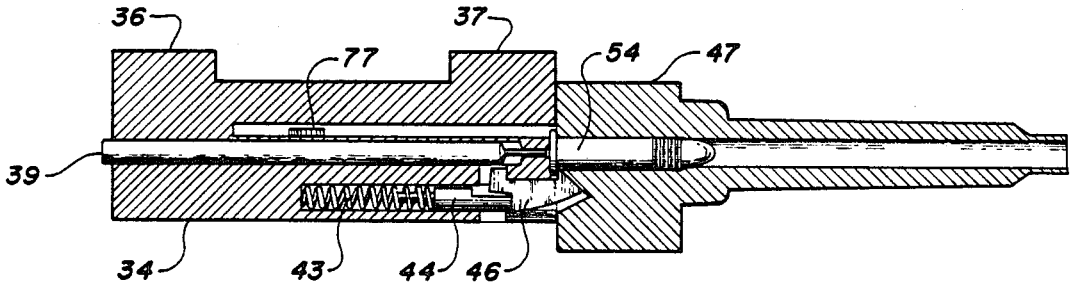
FIG. 33 is a partial cross-sectional top view of the bolt assembly and auxiliary chamber assembly illustrating a cartridge in place preparatory to firing.
Figure 34:
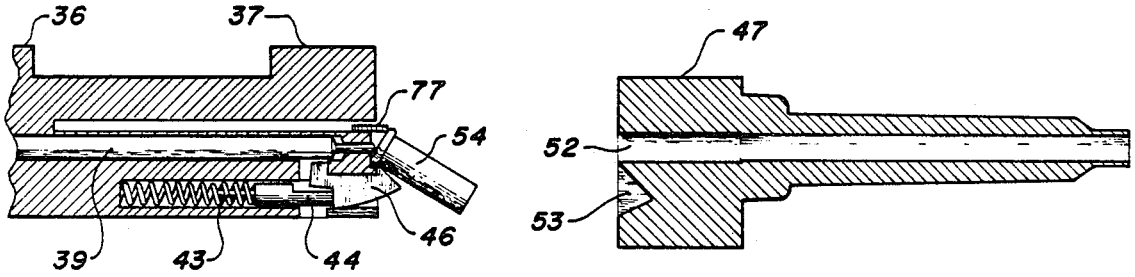
FIG. 34 is a partial cross-sectional top view of the bolt assembly and auxiliary chamber assembly illustrating recoil of the bolt assembly and ejection of the spent cartridge.
Figure 35:
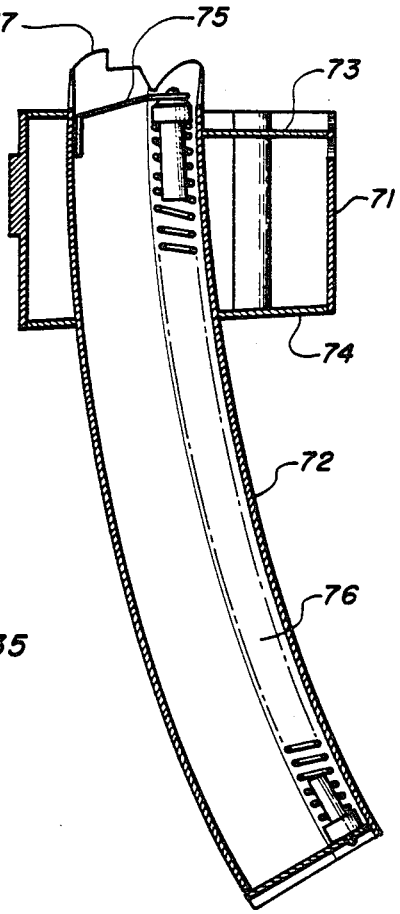
FIG. 35 is a sectional right side view of the magazine assembly of FIG. 37 along lines 35—35.
Figure 36:
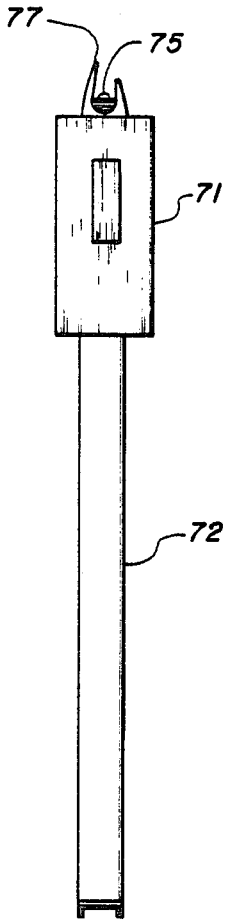
FIG. 36 is a rear view of the magazine assembly.
Figure 37:
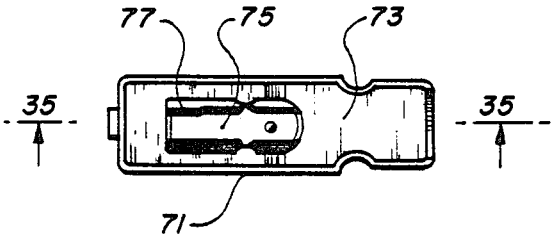
FIG. 37 is a top view of the magazine assembly.

Since the weapon modified with the above described conversion unit employs different, i.e. smaller ammunition, a modification is also required in the magazine assembly. This modification is illustrated in FIGS. 35, 36 and 37. Referring now to these figures, the outer magazine shell 71 is in the shape conventionally employed in this weapon, and hence its form and means for being locked in the weapon are conventional and need not be discussed herein. The magazine shell 71 houses a smaller magazine 72 therein, the magazine 72 being shaped to conform to the new form of ammunition. The magazine 72 is held in the magazine shell 71 by upper and lower closures 73 and 74 respectively. The magazine 72 includes a follower assembly 75 and a spring 76 for feeding the cartridges upwardly in the conventional technique. An ejector 77 is provided on the left rear lip of the magazine 72 which fits into a groove on the underside of bolt 34 as seen in FIGS. 8, 33 and 34.

OPERATION

In the operation of a weapon such as a Mini-14, converted in accordance with the present invention, and assuming that the weapon to be described here is the semi-automatic version and further assuming that there is no cartridge in the chamber 52, the weapon is initially charged by pulling back and releasing the operating rod handle 57 as illustrated in FIG. 4. With this action, the hole 58 in operating rod 56 through which protrudes the operating rod lug 35, of bolt 34, causes a backward movement of the bolt, also compressing the operating rod spring 64. The backward movement of the bolt 33 forces hammer 17 of the weapon into a cocked position. When the operating rod handle 57 is released, the operating rod spring 64 moves the operating rod 56 and bolt forwardly, the bolt engaging a cartridge 54 in magazine 72 forcing it up and into the chamber 52 of the auxiliary chamber 47. As the bolt 33 moves to its forward position against the auxiliary chamber 47, the extractor 46 is urged into a hooking relationship with the rim of the cartridge case 54, as illustrated in the position shown in FIG. 33. The weapon is now in condition to fire the first round.

When the trigger 31 of the weapon is pulled, the hammer 17 in the weapon is released by the conventional mechanism to swing upwardly to strike the projecting rear end of the firing pin 39. The front end of the firing pin 39 then strikes the rim of the cartridge 54 to effect the firing thereof, so that the bullet is forced through the bore 52 of the auxiliary chamber 47 and thence into barrel 2 of the weapon. When the bullet has traveled for sufficient distance down the barrel 2, a portion of the firing gases are directed from the barrel 2 into the gas port 27 of the conventional weapon through the gas piston 26 and into the forward support 65 bleed hole 66. This gas is expelled into the stock 4 cavity and is of no mechanical use. Recoil of the fired cartridge then forces the bolt 33 towards the rear of the receiver 1. As the bolt 33 moves backward, it's extractor 46 which is hooked over the rim of the cartridge case 54, FIG. 34, effects removal of the cartridge case 54 from the auxiliary chamber 47. This backward movement continues until the rim of the cartridge case 54 strikes the ejector 77 as shown in FIG. 34. Since the ejector 77 is offset from the axis of the barrel 2, as the bolt 33 continues its rearward movement, the ejector 77 effects a rotation of the cartridge case 54 so that the cartridge case 54 is released from the extractor 46 and ejected from the weapon. It is to be noted that backward movement of the bolt 33 and operating rod 56 is resisted by the operating rod spring 64 as in the initial charging of the weapon. Also, as the bolt 33 moves backward, it forces the hammer 17 into a cocked position. When the energy in moving the bolt 33 backwardly is expended, the operating rod spring 64 urges the bolt 33 to move in the forward direction toward the auxiliary chamber 47. During this forward movement, the front of the bolt 33 engages the rear end of a fresh cartridge 54 in the magazine 70, and urges the cartridge 54 up and into the chamber 52 in the auxiliary chamber 47. The weapon is then prepared to fire a new round upon reactuation of the trigger 31 of the weapon.

While the invention has been described in detail with reference to a specific embodiment thereof adapted to be employed in combination with a particular weapon of a particular caliber, it will be obvious that many variations and modifications may be made therein without departing from the spirit and scope of the invention, both with respect to use in the Mini-14 and for adapting the invention for use in other weapons and other calibers. It is therefore intended in the following claims to cover all such variations and modifications as may fall between the true spirit and scope of the invention.

I claim:

1. A conversion unit improvement for utilizing 0.22 long rifle caliber ammunition in semi-automatic and fully automatic firearms of the type having an open receiver, a bolt assembly, an operating rod assembly, a magazine, and a barrel having a 223 caliber rifle bore, wherein the improvement comprises:

a replacement bolt assembly including a firing pin operable to strike the rim of a 0.22 long rifle cartridge;

a replacement operating rod assembly including gas venting means for venting to atmosphere gas formed in the barrel during discharge of the firearm;

a replacement magazine including an ejector operable to eject empty cartridges;

an auxiliary chamber including a forward portion having an exterior surface identical in form to the form of the ammunition cartridge for which the firearm was originally intended for precise locking engagement between the auxiliary chamber and the breech end of the barrel of the firearm, said chamber having a rearward portion operable to support the 0.22 caliber long rifle shell; and said auxiliary chamber having a 0.22 caliber bore in registry and in alignment with the bore of said firearm.

2. A conversion unit improvement for utilizing 0.22 long rifle caliber ammunition in semi-automatic and fully automatic firearms of the type having an open receiver, a bolt assembly, an operating rod assembly, a magazine, and a barrel having a 0.223 caliber rifle bore, wherein the improvement comprises:

a replacement bolt assembly;

a replacement operating rod assembly;

a replacement magazine; and an auxiliary chamber; said replacement bolt assembly including a firing pin operable to strike the rim of a 0.22 long rifle cartridge; said replacement operating rod assembly including a forward support operable to engage a gas piston of said firearm, said support lockingly engaging said piston and said forward support including a vent for bleeding discharge gases from said firearm; said replacement magazine adapted to hold and dispense 0.22 long rifle caliber ammunition; and said auxiliary chamber adapted for locking engagement with the breech end of the rifle barrel, said chamber operable to support a 0.22 caliber long rifle shell and said chamber having a 0.22 caliber bore in registry with and in alignment with the bore of said firearm.

3. A conversion unit improvement for utilizing 0.22 long rifle caliber ammunition and semi-automatic and fully automatic firearms of the type having an open receiver, a bolt assembly, an operating rod assembly, a magazine, and a barrel having a 0.223 caliber rifle bore, wherein the improvement comprises:

a replacement bolt assembly;

a replacement operating rod assembly;

a replacement magazine; and an auxiliary chamber; said replacement bolt assembly including a firing pin operable to strike the rim of a 0.22 long rifle cartridge; said replacement magazine adapted to hold and dispense 0.22 long rifle caliber ammunition; and said auxiliary chamber adapted for locking engagement with the breech end of the rifle barrel, said chamber operable to support a 0.22 caliber rifle shell; said chamber having a 0.22 caliber bore in registry with and in alignment with the bore of said firearm; and said chamber including a set screw operable to engage the bottom edge of a locking lug recess to prevent rotational movement of said auxiliary chamber.

* * * * *